US005548187A

United States Patent [19]

Osawa

[11] Patent Number: 5,548,187

[45] Date of Patent: Aug. 20, 1996

[54] METHOD OF FLICKER-FREE LIGHTING HOT-CATHODE LOW-PRESSURE RARE GAS DISCHARGE LAMP

[75] Inventor: Takashi Osawa, Kakegawa, Japan

[73] Assignees: Mitsubishi Denki Kabushiki Kaisha, Tokyo; Osram-Melco Limited, Kanagawa, both of Japan

[21] Appl. No.: 388,842

[22] Filed: Feb. 15, 1995

[30] Foreign Application Priority Data

Mar. 30, 1994 [JP] Japan ..... 6-060673

[51] Int. Cl.[6] ..... H05B 39/00

[52] U.S. Cl. ..... 315/94; 315/32; 315/71; 313/632

[58] Field of Search ..... 315/94, 32, 71; 313/632, 631

[56] References Cited

U.S. PATENT DOCUMENTS

| | | | |
|---|---|---|---|
| 4,902,933 | 2/1990 | Roberts | 315/94 |
| 4,914,347 | 4/1990 | Osawa et al. | 313/485 |
| 4,972,115 | 11/1990 | Osawa et al. | 313/37 |
| 5,338,110 | 8/1994 | Byun | 315/94 |
| 5,432,406 | 7/1995 | Brooks | 315/94 |

FOREIGN PATENT DOCUMENTS 1157053 11/1989 Japan .

OTHER PUBLICATIONS

Yoshiji Yoshike, "Fluorescent Xenon Glow Lamp," Toshiba Review, vol. 40, No. 12, pp. 1079–1082.

Mitsubishi Denki Giho, vol. 65, No. 4, 1991, pp. 82–86.

Proceedings of 1991 Annual Conference of the Illuminating Engineering Institute of Japan, pp. 81–84.

*Primary Examiner*—Frank Gonzalez
*Assistant Examiner*—Reginald A. Ratliff
*Attorney, Agent, or Firm*—Leydig, Voit & Mayer

[57] ABSTRACT

The present invention provides a method of lighting a hot-cathode type low-pressure rare gas discharge lamp without flicker. The method has the steps of operating, as a hot cathode, at least one of electrodes provided at both ends of a glass valve in a stable discharge state, and emitting light from a fluorescent material with the ultraviolet rays generated by the discharge of low-pressure rare gas sealed in the glass valve, or directly with visible light. The hot cathode is heated at least during lighting. In the method, the temperature of the hot cathode relative to the lamp current flowing between the electrodes is set within a region to prevent flicker in the discharge lamp.

1 Claim, 1 Drawing Sheet

METHOD OF FLICKER-FREE LIGHTING HOT-CATHODE LOW-PRESSURE RARE GAS DISCHARGE LAMP

BACKGROUND OF THE INVENTION

1. Field of the Invention

The present invention relates to a low-pressure rare gas discharge lamp used for an OA apparatus such as a facsimile (FAX) machine, a copying machine, etc., and particularly to a method of lighting a hot-cathode type low-pressure rare gas discharge lamp including using at least one of electrodes provided at each end of a glass valve as a hot cathode operated in a stable discharge state, and emitting light from a fluorescent material with ultraviolet rays generated by discharge of the low-pressure rare gas sealed in the glass valve, or with visible light, directly 2. Description of the Related Art A lamp which employs light emission of a discharge in a rare gas has recently been used as a light source for an OA apparatus. However, practical use of such a lamp, requires preventing distortion of the luminance distribution.

For example, moving stripes occur which are peculiar to a low-pressure rare gas discharge, as disclosed in Extended Abstracts No. 57 of the National Convention in the 75th Anniversary of the Founding of Illumination Society (24th), p. 84, 1991, the Committee/Executive Committee of the National Convention of Illumination Society.

This is described in detail in Technical Report of Mitsubishi Denki, 65 (4), pp. 82–86, 1991. Since bright and dark portions of a discharge positive column irregularly move to form stripes in the axial direction of the lamp, when the lamp is used as a reading light source for an OA apparatus, the moving stripes cause an instantaneous distortion in the luminance distribution, and adversely affects reading in some cases.

A direct current lighting method is thus proposed to solve the above problem. In this method, since groups of stripes having the same size regularly occur in the lamp and move at a high speed in one direction, a reading CCD is uniformly affected by the moving stripes during reading of an original in spite of the occurrence of the moving stripes, and thus the amount of light received is made uniform, thereby preventing the adverse effects of the moving stripes.

On the other hand, Japanese Patent Laid-Open No. 1-157053 discloses means for heating a hot cathode to a temperature within the range of 800° C. to 1200° C. during lighting so as to improve the luminance distribution.

The high-speed operation of recent OA apparatus decreases the one-line reading time of FAX, and brings about a demand for higher stability of the light output of a lamp due to an increase in the required gradation number, i.e., gray scale.

However, although not all lamps produce variations in light quantity other than the moving stripes, i.e., variations in light quantity (referred to as flicker hereinafter) for a longer period of time than the moving stripes, which has not been reported as yet, some lamps irregularly produce flicker.

With a long reading time and many irregularities, a change in the total amount of light received for one line due to flicker is not a problem. However, in an apparatus having a high-operation speed and a short reading time, such as recent OA apparatus, the adverse effects on reading due to flicker other than the moving stripes cause a critical problem.

Another conceivable factor which further increases the problems caused by flicker is an increase in the number of reading gradations. If a simple decision is made as to whether each portion of one reading line is black or white, a variation in light quantity is not a critical problem. However, when the number of gray scale gradations is as large as 256, a light source must have a stability of light output corresponding to a variation of 1/256 or less per reading time in order to read a density difference of 1/256 of an original.

In addition, flicker does not always occur during lighting of the lamp, as described above, and cannot be controlled from outside of the apparatus.

SUMMARY OF THE INVENTION

An object of the present invention is to solve the described problems by providing a method of lighting a hot-cathode type low-pressure rare gas discharge lamp which can prevent flicker when the lamp is lit.

A method of lighting a hot-cathode type low-pressure rare gas discharge lamp in accordance with the present invention comprises the steps of operating, as a hot-cathode, at least one of electrodes provided at both ends of a glass valve in a stable discharge state and emitting light from a fluorescent material, on the basis of the discharge of the low-pressure rare gas sealed in the glass valve, and heating the hot-cathode at a temperature thereof which is set to be within a range such that the emission of electrons from the hot cathode is not excessive in relation to the lamp current flowing between the electrodes when the lamp is lit.

This method can prevent the unstable state caused by emission of excess electrons from the hot cathode, and the occurrence of flicker when the lamp is lit.

Assuming that the lamp current flowing between the electrodes is $I_L$ (mA), and the temperature of the hot cathode is $T_f$, (C), the temperature range is set to the following:

If $I_L<55$ mA, $T_f<6.5\ I_L+592.5$ (° C.)

If 55 mA$\leqq I_L$, $T_f<2\ I_L+840$ (° C.)

DESCRIPTION OF THE PREFERRED EMBODIMENTS

Figure 1:
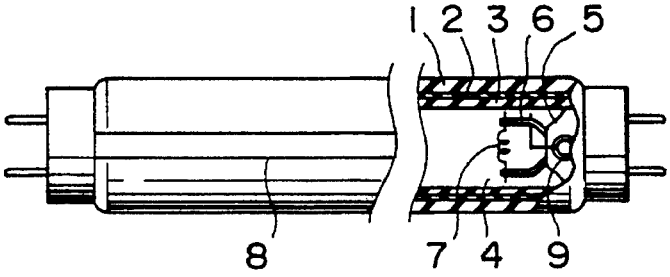
FIG. 1 is a partially cut-away front view illustrating an embodiment of the present invention.

FIG. 1 is a partially cut-away front view illustrating a hot-cathode low-pressure rare gas discharge lamp having an opening and employing a method of lighting a hot-cathode low-pressure rare gas discharge lamp in accordance with an embodiment of the present invention.

In FIG. 1, reference numeral 1 denotes a glass tube having an outer diameter of 10 mm and a wall thickness of 0.5 mm; reference numeral 2, a reflecting film formed on the inner surface of the glass valve 1; and reference numeral 3, a fluorescent layer formed on the reflecting film 2 and comprising a green fluorescent material having a composition of zinc silicate $Zn_2SiO_2$:Mn (for example, green fluorescent material $GP_1G_1$ produced by Kasei Optonics Co., Ltd.). An opening 8 having a width of 2 mm is formed in the surface of the glass tube 1 along the lengthwise direction of the fluorescent layer 3 and the reflecting film 2, where the fluorescent layer 3 and the reflecting layer 2 are not present.

Reference numeral 4 denotes an electrode comprising a pair of lead wires 6 which are mounted in a stem 5 for hermetically sealing an end of the glass tube 1, and a tungsten filament coil 7 as a hot cathode is connected between the lead wires 6. The filament coil 7 is a so-called triple helix coated with an electron emitting substance.

The distance between the electrodes is set to 260 mm. A gas mixture containing 10% Xe and 90% Ne is sealed in the glass tube 1 at a pressure of 1 Tort. Reference numeral 9 denotes a getter which is able to adsorb gases during the lifetime of the lamp.

The discharge lamp is lighted with direct current produced by half-wave rectification in a bridge circuit using a sine-wave power source of 50 kHz.

Figure 2:
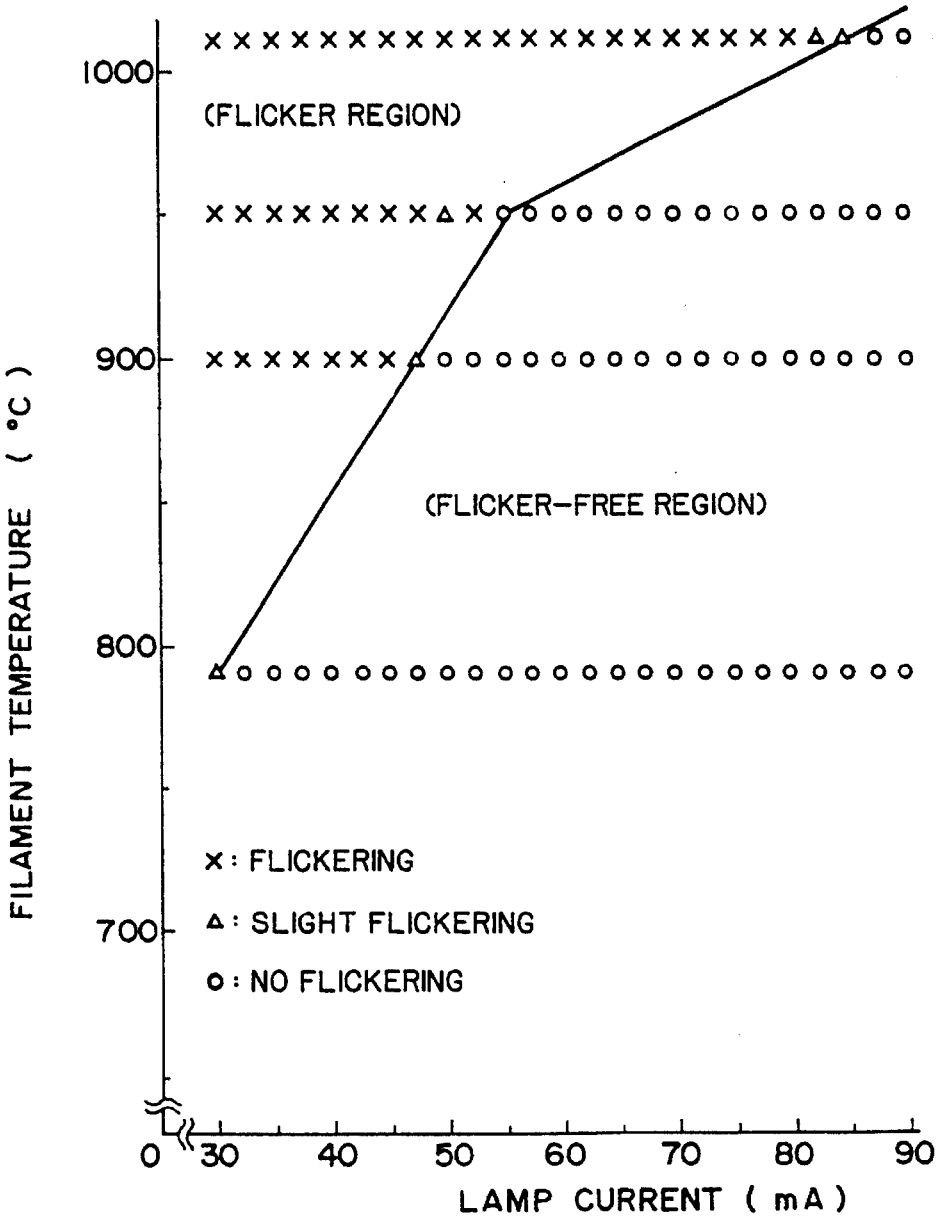
FIG. 2 is a graph illustrating relationships between the temperature of a hot cathode, lamp current, and flicker.

FIG. 2 is a graph showing relationships between the lamp current flowing between the electrodes 4, the temperature of the filament 7 of each electrode 4 and flicker. Flicker was measured by the amount of the light emitted in the center and the opening 8 of the lamp using an optical probe while changing the lamp current flowing between the electrodes 4 at a desired filament temperature which was set by controlling the current flowing through the filament 7.

In the graph, mark 0 indicates no flicker, mark Δ indicates slight occurrent of flicker, and mark x indicates significant flicker. The results shown in FIG. 2 were obtained from synthesis of the results of measurements of ten lamps. Even when lamps were judged (mark x) to fall into the flicker region shown in FIG. 2, the lamps did not always produce flicker. Some lamps in this region any did not produce flicker.

By contrast, all lamps which were judged (mark x) to fall into the flicker-free region, shown in FIG. 2, did not produce flicker. In other words, the lamps produce no flicker within the flicker-free region, and the lamps have a high possibility of producing flicker within the flicker region.

This embodiment can thus prevent the occurrence of flicker by controlling the relation between the lamp current and filament temperature so as to operate the lamp within flicker-free region.

Conceivable mechanism flicker-free and flickering operation depending upon the relation between the lamp current and the filament temperature.

An ability to emit a sufficient number of electrons is required for passing a lamp current. When the filament serves as a hot cathode, the electron emission ability can be controlled by controlling the temperature of the hot cathode as a.

For example, the electrode temperature of the hot cathode should be 950° C. or less for passing a lamp current of 55 mA. If the temperature of the hot cathode is higher than 950° C., electrons may be emitted from the hot cathode in a number greater than the number of electrons required for maintaining the lamp current, thereby interfering with the smooth flow of electron current.

When the temperature of the hot cathode is-excessively high as compared with a lamp current, therefore, excess electrons may be emitted from the hot cathode, thereby unstably lighting the discharge lamp and creating flicker as shown in FIG. 2.

In accordance with this theory of operation, when the relation between the lamp current and filament temperature falls outside the flicker producing region, the electrons that are emitted from the hot cathode do not disturb the flow of lamp current, so that the discharge lamp can be stably lit without flicker in the flicker-free region shown in FIG. 2.

For example, when a lamp current of 55 mA flows, if the hot cathode temperature is about 750° C. or less, the lamp current cannot be maintained only by the thermoelectrons emitted from the hot cathode, thereby increasing the cathode drop voltage and causing field electrons to be emitted. This phenomenon was observed by measuring the presence of Ne light emitted in the vicinity of the cathode in discharge in a Xe/Ne gas mixture. However, in this case, the flicker defined in the present invention was not observed.

Since the temperature of the hot cathode is conventionally set to 800°to 200° C., as disclosed in Japanese Patent Laid-Open No. 1-57053, the discharge lamp is frequently lighted in the flicker region due to variations in source voltage or the like.

As a result of linear approximation of the boundary between the flicker occurring region and the flicker-free region shown in FIG. 2, the following equations were obtained:

$$\text{If } I_L<55 \text{ mA}, T_f=6.5\ I_L+592.5\ (^\circ \text{ C.})$$

$$\text{If } 55 \text{ mA} \leqq I_L, T_f=2\ I_L+840\ (^\circ \text{ C.})$$

wherein $I_L$ is the lamp current, and $T_f$ is the filament temperature.

In addition, no flicker occurs in the discharge lamp at a filament temperature lower than that at the boundary between the flicker region and the flicker-free region relative to the lamp current $I_L$, as shown in FIG. 2. If the filament temperature $T_f$ satisfies the relations below, no flicker occurs.

$$\text{If } I_L<55 \text{ mA}, T_f<6.5\ I_L+592.5\ (^\circ \text{ C.})$$

$$\text{If } 55 \text{ mA} \leqq I_L, T_f<2\ I_L+840\ (^\circ \text{ C.})$$

This embodiment can thus prevent the occurrence of flicker in the discharge lamp by setting the filament temperature $T_f$ within the regions shown by the above relative to the lamp current $I_L$.

Although the embodiment relates to direct current lighting by half-wave rectification as an example, alternating current produces the same effects.

Also, dome flickering is caused by the discharge phenomenon itself, and is not related to the kind or presence of fluorescent material. Further, although this phenomenon was measured for different diameters and lengths the lamp tube, the results were the same.

Although the embodiment described uses Xe (Ne is added as a buffer gas) as a light emission gas, the use of He, Ne, Ar or Kr produces the same effects.

Further, since the variation compensating region of the discharge lamp at a rated input is generally determined, the relations shown by the above are satisfied even at the upper limit of the variation compensating region. For example, if the voltage variation of an input voltage of 24 V is 6%, the relation between the lamp current $I_L$ and the filament temperature $T_f$ is not set to satisfy the at the rated input of 24 V, but at an input voltage of about 25.5 V in consideration of the presence of a voltage variation of +6%. This can prevent lighting of the discharge lamp within the flicker region and thus prevent flickering in the discharge lamp.

As described above, in the present invention to the temperature of the hot cathode and the lamp current flowing between the electrodes is set to prevent the emission of excess electrons from the hot cathode and to prevent an unstable state of the lamp. The present invention allows for stable lighting of the discharge lamp and for preventing the flickering.

In addition, since the lamp current $I_L$ (mA) slowing between the electrodes and the temperature $T_f$ (C) of the hot cathode are set to satisfy the equations below, the present invention has the effect of stably lighting the discharge lamp without flicker.

$$\text{If } I_L<55 \text{ mA}, T_f<6.5\ I_L+592.5\ (^\circ\text{C.})$$

$$\text{If } 55 \text{ mA} \leqq I_L, T_f<2\ I_L+840\ (^\circ\text{C.})$$

What is claimed is:

1. A method of lighting a hot cathode low pressure rare gas discharge lamp including a glass tube containing a rare gas at a low pressure, and at least one cathode at an end of the glass tube, comprising:

passing a current $I_L$, in milliamperes, through the cathode in the glass tube of the discharge lamp and controlling a temperature $T_f$ of the cathode so that when $I_L$ is less than 55 milliamperes, $T_f$, in degrees centigrade, is less than (6.5 $I_L$+592.5), and when $I_L$ is at least 55 milliamperes, $T_f$, in degrees centigrade, is less than (2 $I_L$+840) whereby flicker-free lighting of the discharge lamp is achieved.

* * * * *